US006939274B2

(12) United States Patent
Emick

(10) Patent No.: US 6,939,274 B2
(45) Date of Patent: Sep. 6, 2005

(54) DUMBBELL LIFTING APPARATUS

(76) Inventor: Daniel W. Emick, 4882 Rte. 87 Hwy., Williamsport, PA (US) 17701

( * ) Notice: Subject to any disclaimer, the term of this patent is extended or adjusted under 35 U.S.C. 154(b) by 269 days.

(21) Appl. No.: 10/393,967

(22) Filed: Mar. 21, 2003

(65) Prior Publication Data

US 2004/0185989 A1 Sep. 23, 2004

(51) Int. Cl.[7] ..... A63B 21/00
(52) U.S. Cl. ..... 482/104; 482/106
(58) Field of Search ..... 482/104–108; 294/26, 19.1, 159, 137; 220/254; D9/454, 455

(56) References Cited

U.S. PATENT DOCUMENTS 2,631,882 A * 3/1953 Satre ..... 294/26
4,463,977 A * 8/1984 Wyatt ..... 294/26
4,858,977 A * 8/1989 Mitchell ..... 294/82.1
4,943,052 A * 7/1990 Powers ..... 482/108
4,955,650 A * 9/1990 Davey ..... 294/26
6,247,739 B1 * 6/2001 Lyon ..... 294/159

* cited by examiner

*Primary Examiner*—Jerome W. Donnelly
(74) *Attorney, Agent, or Firm*—Thomas R. Shaffer, Esq.

(57) ABSTRACT

A dumbbell lifting device is used to lift a dumbbell having a central bar member and attached free weight plates or solid cast. The device includes a body member, a pair of handle members which extend upwardly and outwardly away from the body, a tube member rotatably attached to the body and a pair of spaced apart stem hooks attached to the tube member. The hooks removably attach and hold a central bar member of a dumbbell and allow said dumbbell to be lifted upwardly and downwardly by the handle members.

10 Claims, 4 Drawing Sheets

DUMBBELL LIFTING APPARATUS

BACKGROUND OF THE INVENTION

1. Field of the Invention

The present invention relates to exercise device for use with free weights in the form of dumbbell or a barbell. More particularly, the present invention relates to a dumbbell (or barbell) lifting apparatus which provides a pair of handle members to aid in performance of pile exercises of the quadriceps, gluteals and adductor muscles of the lower torso 2. Prior Art A variety of exercise devices have been proposed and are in use today for the exercise of virtually every muscle of the human body. One type of exercise is known as a pile exercise. A pile exercise differs from a "squat" exercise by virtue of an exaggerated wide leg stance which the exerciser must assume. Such widened leg stance has the effect of placing a greater stress on the adductor (or inner thigh) and buttocks than the "squat" exercise movement. Athletes in need of greater overall lower body strength benefit greatly from the pile exercise.

A problem arises, however, when leg strength exceeds that of the grip or low back thereby limiting the amount of weight one may use with conventional dumbbells alone. This forces athletes to then switch to the barbell dead lift exercise, an exercise in which one repeatedly pulls a barbell from the floor by squatting and standing with arms extended at sides or in front of torso. The hands grip the barbell with a "no slip" reverse grip. The drawbacks of this exercise are, first, that the knees may come into contact with the bar as the barbell rises and the knees straighten and, second, that low back stress is increased.

Two well known traditional methods of adding resistance to one's body weight in performing a pile exercise are: (1) to place a barbell on the upper back behind one's shoulders or (2) to hold a single dumbbell vertically with both hands open and gripping the weighted end, not the stem, of the dumbbell. Both of these methods have significant limitations. In the case of the barbell across the upper back, such method unnecessarily loads the cervical spine thereby causing compression, discomfort and risk of injury of to the back or spine.

The dumbbell methods has two primary drawbacks. First, because leg strength will eventually exceed grip strength, the amount which can be lifted is thereby limited and such method may place the user at risk of injury from dropping the dumbbell as the limits of grip strength are exceeded. The second drawback with vertically lifting a dumbbell by one of its ends is that the length of the dumbbell itself limits the range of motion as the lower end of the dumbbell will prematurely hit the floor because of the length if the dumbbell extends vertically downward toward the floor away from the gripped end.

A more recent method of performing pile exercises involves the use of "kettle balls" which are generally spherical cast iron weights with handles which come in various fixed, non adjustable poundages. Kettle balls are designed for a variety of different exercise regimens and movements addressing multiple muscle groups. The primary disadvantage of kettle balls is that one must purchase a multitude of kettle balls to accommodate strength increases and various user capabilities since the weight of each kettle ball can not be adjusted. An additional disadvantage is that the handles on the kettle balls do not allow for any vertical adjustment to accommodate various exerciser's physical dimensions.

SUMMARY OF THE INVENTION

The present invention provides a dumbbell lifting apparatus which reduces existing problems associated with the piles exercise by ensuring biomechanically correct hand positioning. This allows users to keep their torsos more vertical thereby reducing unnecessary stress to the lumbar spine. Additionally, the present invention affords users a biomechanical grip advantage by placing hands in a more natural "palms facing body" position which constitues an improvement to even a common barbell grip. This aids in delivering a more secure and efficient line of pull. The present invention also allows for rapid and incremental weight changes and, because it uses conventional weight plates attached to a standard dumbbell, no additional costly specialized weight products are needed.

It its simplest form, the present invention provides a dumbbell lifting apparatus for a dumbbell having a central bar member comprising a body member; a pair of handle members attached to said body; a tube member rotatably attached to said body; at least one stem hook attached to said tube member, said at least one stem hook adapted to removably attach and hold a central bar member of a dumbbell to allow said dumbbell to be lifted upwardly and downwardly by said handle members.

Preferably the handle members extend outwardly and upwardly away from said body member.

Preferably said handle members extend outwardly away from said body member at an angle of at less than 80 degrees and greater then 10 degrees.

Preferably said handle members outwardly away from said body member at an angle of approximately 20 degrees.

Preferably said handle members upwardly away from said body member at an angle of at less than 45 degrees and greater then 5 degrees.

Preferably said handle members upwardly away from said body member at an angle of approximately 15 degrees.

Preferably said handle members have end cap flanges thereon which abut the hands of a user of said apparatus.

Preferably said handle members have foam grip pads thereon.

Preferably said at least one stem hook is a pair of spaced apart hooks.

DETAILED DESCRIPTION OF THE PREFERRED EMBODIMENTS

Figure 1:
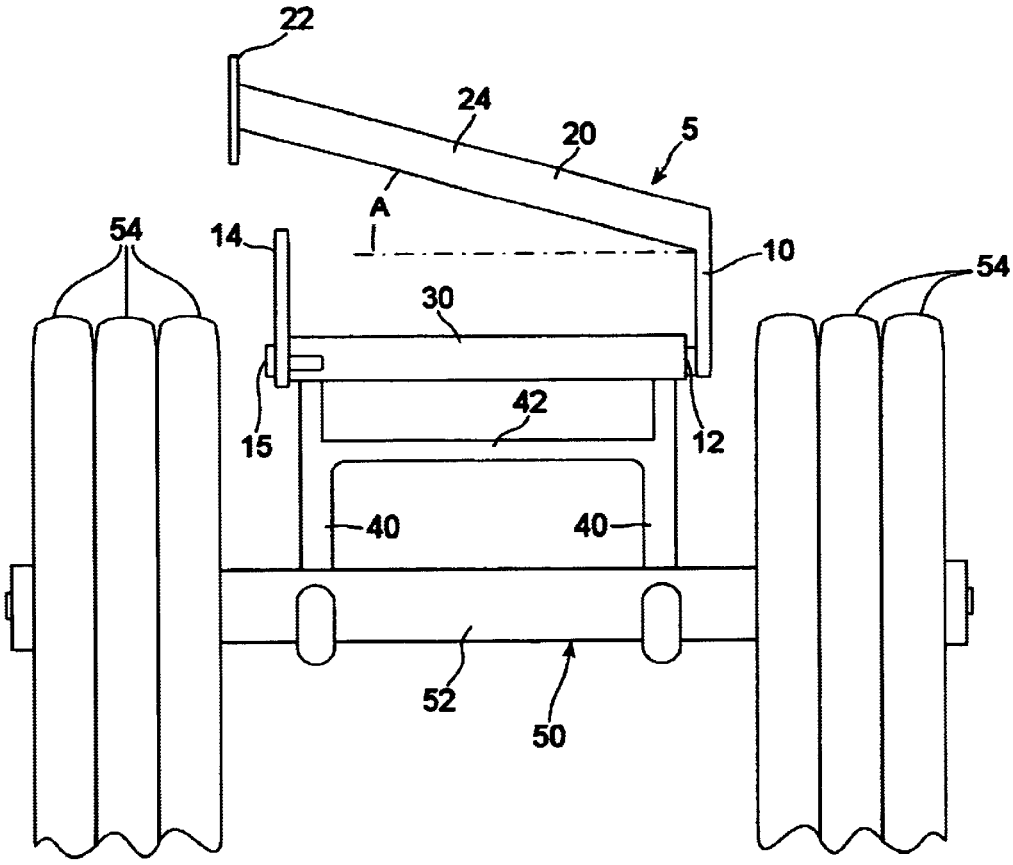
FIG. 1 is a side elevation view of the dumbbell lifting apparatus of the present invention.

Referring to the Figures the dumbbell lifting apparatus 5 is provided for lifting a dumbbell 50 having a central bar member 52 with free weight plates (or solid cast) 54 attached thereto. The lifting apparatus 5 includes a body member 10 which includes a rod member 12 which is positioned parallel to the central bar 52 when in use.

A pair of handle members 20 are attached to the body 10. A tube member 20 is rotatably attached to the rod member 12 of the body 10. The tube member 20 is secured in place by plate 14 which is screwed into rod member 12 by screw 15. A pair of spaced apart stem hooks 40 (which are connected to a hook bar 40) are attached to said tube member 30. The hooks 40 are adapted to removably attach and hold the central bar member 52 of a dumbbell 50 to allow said dumbbell 50 to be lifted upwardly and downwardly by said handle members 20.

Figure 4:
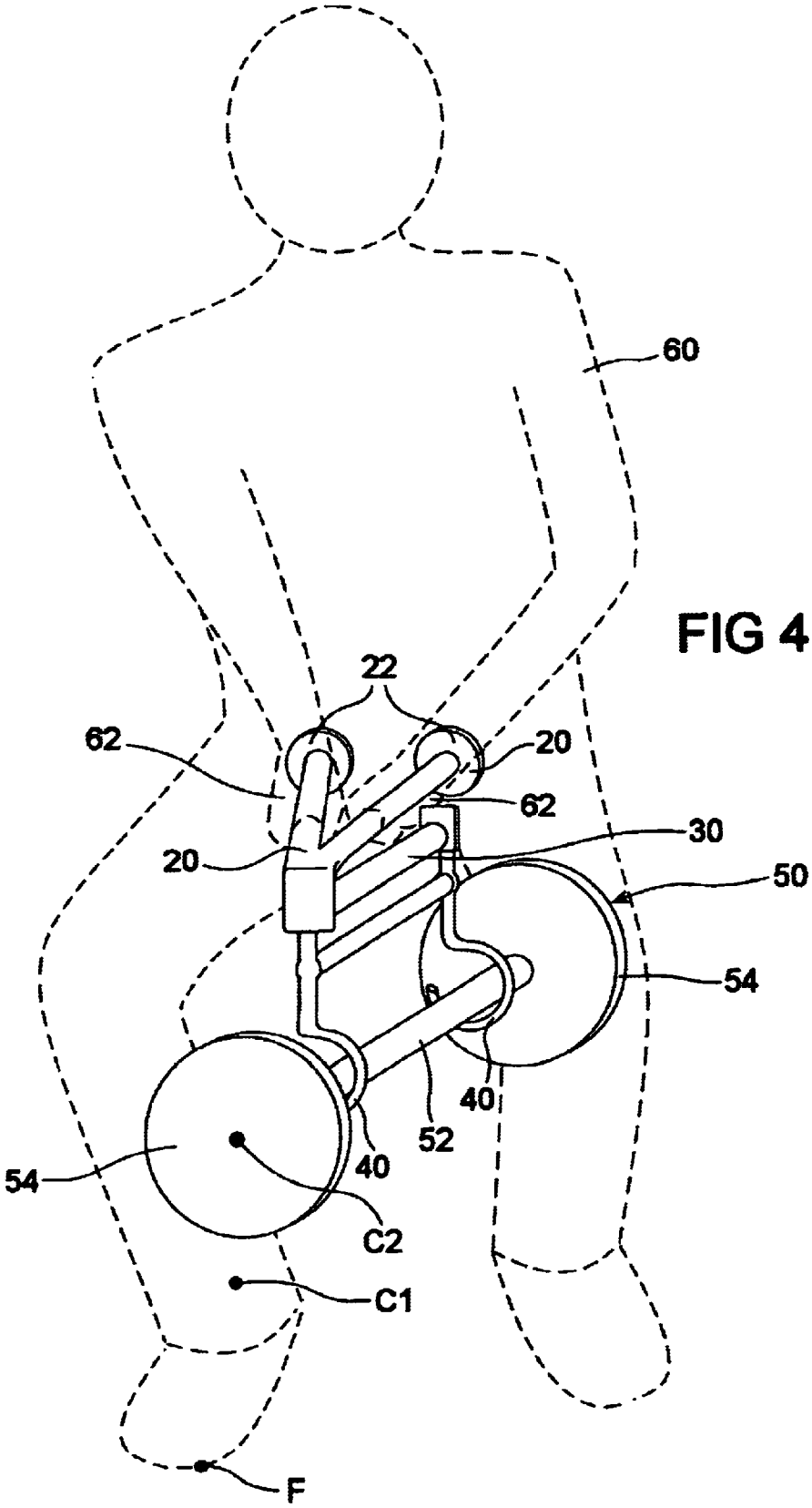
FIG. 4 is a perspective view of the dumbbell lifting apparatus of the present invention shown in use.

As shown in FIG. 4, the device 5 is used to lift the dumbbell from the floor F at which time the center of weight plate 54 is in the location shown as C1. When lifted upwardly, the center of the weight plate 54 is in the location shown as C2.

Figure 2:
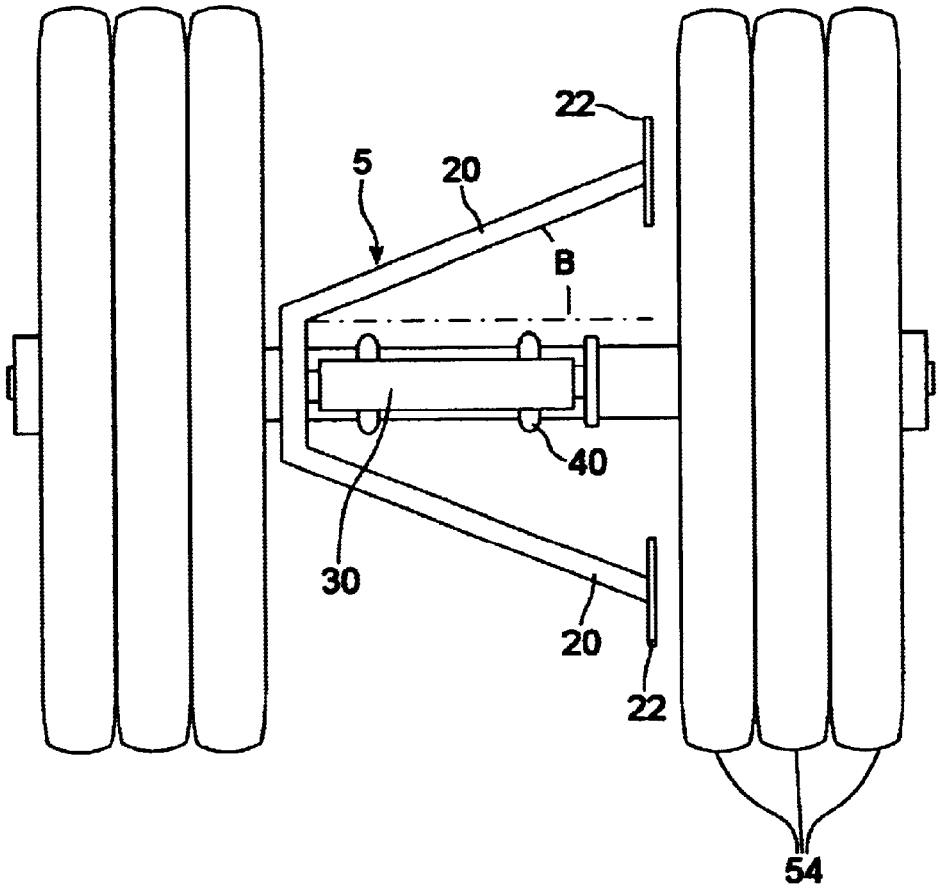
FIG. 2 is a top plan view of the dumbbell lifting apparatus of the present invention.
Figure 3:
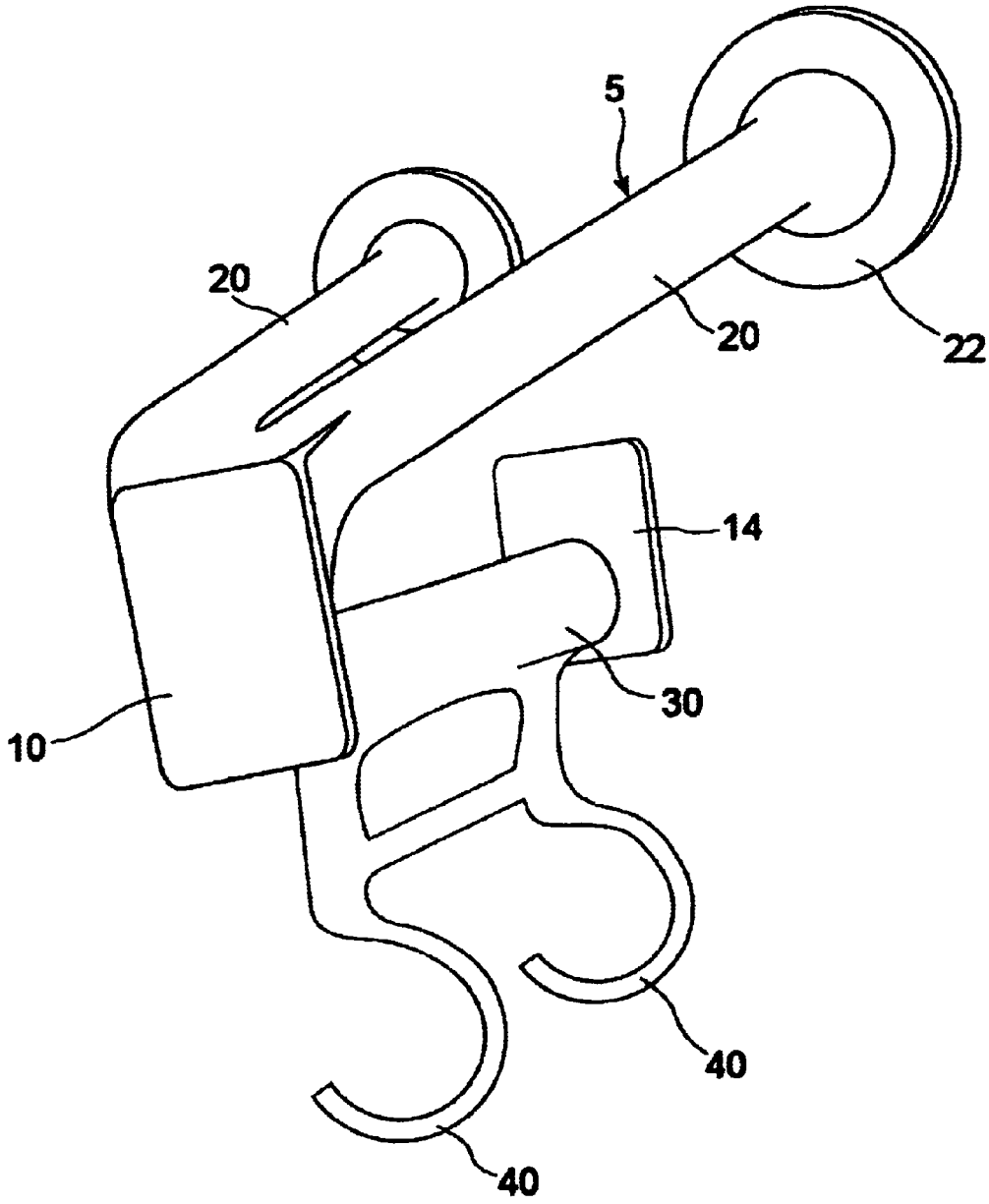
FIG. 3 is a perspective view of the dumbbell lifting apparatus of the present invention.

The handle members 20 extend outwardly and upwardly away from said body member 10. The handle members 20 extend outwardly away from said body member at an angle B (as shown in FIG. 2) which angle is less than 80 degrees and greater then 10 degrees. Preferably angle B is approximately 20 degrees. The handle members extend upwardly away from said body member at an angle A (as shown in FIG. 1) which angle is less than 45 degrees and greater then 5 degrees. Preferably angle A is approximately 15 degrees.

The handle members 20 have end cap flanges 22 thereon which abut the hands 62 of a user 60 of the apparatus 5 as shown in FIG. 4. If desired the handle members 20 may foam grip pads 24 thereon.

As will be readily apparent, any number of conventional annular weight plates 54 may be added or removed from the central bar 52 of the dumbbell in the manner well known in the art. The lifting apparatus 5 of the present invention which is shown alone in FIG. 5 can be used to lift any form or weight of dumbbell or barbell which has a central bar 52.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A dumbbell lifting apparatus for a dumbbell having a central bar member comprising:

a) a body member;

b) a pair of handle members attached to said body;

c) a tube member rotatably attached to said body;

d) at least one stem hook attached to said tube member, said at least one stem hook adapted to removably attach and hold a central bar member of a dumbbell to allow said dumbbell to be lifted upwardly and downwardly by said handle members.

2. A dumbbell lifting apparatus according to claim 1 wherein said handle members outwardly and upwardly away from said body member.

3. A dumbbell lifting apparatus according to claim 1 wherein said handle members extend outwardly away from said body member at an angle of at less than 80 degrees and greater then 10 degrees.

4. A dumbbell lifting apparatus according to claim 1 wherein said handle members extend outwardly away from said body member at an angle of approximately 20 degrees.

5. A dumbbell lifting apparatus according to claim 1 wherein said handle members extend upwardly away from said body member at an angle of at less than 45 degrees and greater then 5 degrees.

6. A dumbbell lifting apparatus according to claim 1 wherein said handle members extend upwardly away from said body member at an angle of approximately 15 degrees.

7. A dumbbell lifting apparatus according to claim 1 wherein said handle members extend outwardly away from said body member at an angle of approximately 20 degrees and upwardly away from said body member at an angle of approximately 15 degrees.

8. A dumbbell lifting apparatus according to claim 1 wherein said handle members have end cap flanges thereon which abut the hands of a user of said apparatus.

9. A dumbbell lifting apparatus according to claim 1 wherein said handle members have foam grip pads thereon.

10. A dumbbell lifting apparatus according to claim 1 wherein said at least one stem hook is a pair of spaced apart hooks.

* * * * *